United States Patent [19]

Slaybaugh

[11] 3,940,887

[45] Mar. 2, 1976

[54] HYDRAULICALLY CONTROLLED PNEUMATIC SWINGING DOOR OPERATOR

[75] Inventor: Loren E. Slaybaugh, Arlington Heights, Ill.

[73] Assignee: Republic Industries, Inc., Chicago, Ill.

[22] Filed: Nov. 18, 1974

[21] Appl. No.: 524,611

[52] U.S. Cl. ..... 49/137; 49/265; 49/334; 91/394; 92/9; 92/131; 92/137

[51] Int. Cl.[2] ..... E05F 15/02

[58] Field of Search ..... 49/115, 137, 139, 324, 49/326, 264, 265, 273, 274, 334; 91/357, 402, 394, 408, 409, 368; 92/147, 131, 137, 9

[56] References Cited

UNITED STATES PATENTS

| | | | |
|---|---|---|---|
| 2,489,911 | 11/1949 | Lifner | 91/24 X |
| 2,618,365 | 11/1952 | Seagren | 49/137 X |
| 3,864,875 | 2/1975 | Hewitt | 49/334 X |

FOREIGN PATENTS OR APPLICATIONS

| | | | |
|---|---|---|---|
| 575,440 | 2/1946 | United Kingdom | 91/131 |

*Primary Examiner*—Kenneth Downey
*Attorney, Agent, or Firm*—McCaleb, Lucas & Brugman

[57] ABSTRACT

A hydraulically controlled pneumatic swinging door operator comprising a pneumatic cylinder with a piston therein, a continuous loop connected to opposite sides of the piston and entrained at its ends over sprockets, one of which makes driving or driven connection with a door, a passive hydraulic system including a cylinder and a piston, the piston of which is carried by the side of the loop opposite the side carrying the pneumatic piston, and passage work in the hydraulic system for controlling the flow of hydraulic fluid in said cylinder from one side of the hydraulic piston to the other side.

1 Claim, 8 Drawing Figures

HYDRAULICALLY CONTROLLED PNEUMATIC SWINGING DOOR OPERATOR

SUMMARY OF THE INVENTION

While hydraulic swinging door operators have been highly developed, plants, stores, and other buildings with already established pneumatic systems frequently prefer that their door operators likewise be powered in this fashion. Among other things, there is some feeling that a pneumatic system is more trouble free than a hydraulic system.

The present invention includes a continuous loop entrained over two spaced sprockets, one of which is adapted for connection to a door to drive or be driven by the door in opening and closing. One side of the loop between the sprockets incorporates a pneumatic piston enclosed within a pneumatic cylinder. Springs on each side of the piston within the cylinder maintain the piston normally in a central, door-closed position. Depending on the desired direction of movement of the door, either end of the pneumatic cylinder is connected to a source of air under pressure through mat-switch or similarly controlled valving means. The other side of the loop has a hydraulic piston therein contained within a hydraulic cylinder. Passageways provide for the controlled flow of hydraulic fluid from one side of the piston to the other. The hydraulic system is purely passive, simply following the movement of the pneumatic piston, and serves only to control and restrain the movement of the door.

The advantages of this structure are many. The same unit can be employed for left or right hand doors opening either inward or outward. Pneumatic pressure in itself, without restraint, is an unsatisfactory power source for door operators because of its elasticity. The hydraulic controller in the present invention imposes a non-elastic response to the pneumatic pressure and has the capability of adjustably controlling the rate of movement of the door differently at different points in the arc of its swing.

The springs on opposite sides of the pneumatic piston accurately hold the piston at a central, door-closed position within the cylinder. The springs also permit a panic breakaway for emergency exit from a normally inwardly opening door and permit a controlled opening and closing of the door in either direction in the event of a switch or power failure. The resiliency of the two springs may differ from each other so as to impose a greater resistance in the panic exit direction than in opposition to the pneumatic opening.

Other objects and advantages of this invention will be apparent from the following description and drawings.

DESCRIPTION OF THE PREFERRED EMBODIMENT

Figures 1, 2, 3, 4, 5, 6, 7, 8:
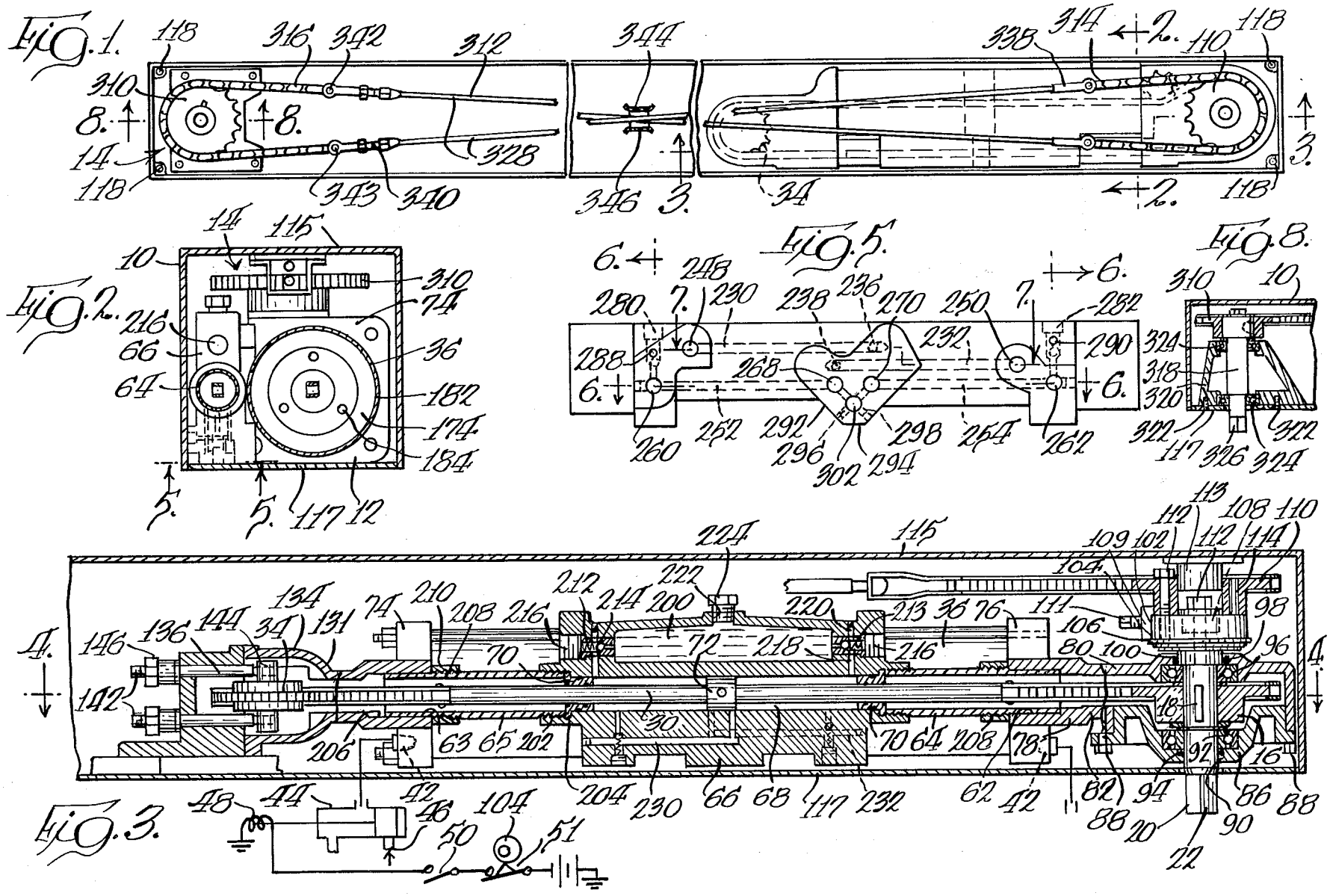
FIG. 1 is a top plan view of a device embodying the invention as applied to a double door, shown with cover removed.
FIG. 2 is a section taken along the line 2—2 of FIG. 1 looking in the direction of the arrows with certain parts omitted showing the relationship of the hydraulic controller and the pneumatic system of the door operator.
FIG. 3 is a section taken substantially along the line 3—3 of FIG. 1 looking in the direction of the arrows.
FIG. 4 is a section taken along the line 4—4 of FIG. 3 looking in the direction of the arrows.
FIG. 5 is an enlarged plan view of the underside of the hydraulic controller taken from the line 5—5 of FIG. 2 looking in the direction of the arrows.
FIG. 6 is a developed section taken along the line 6—6 of FIG. 5 looking in the direction of the arrows.
FIG. 7 is a section taken along the line 7—7 of FIG. 5 looking in the direction of the arrows.
FIG. 8 is a section taken along the line 8—8 of FIG. 1 looking in the direction of the arrows.
Figures 4, 6, 7:
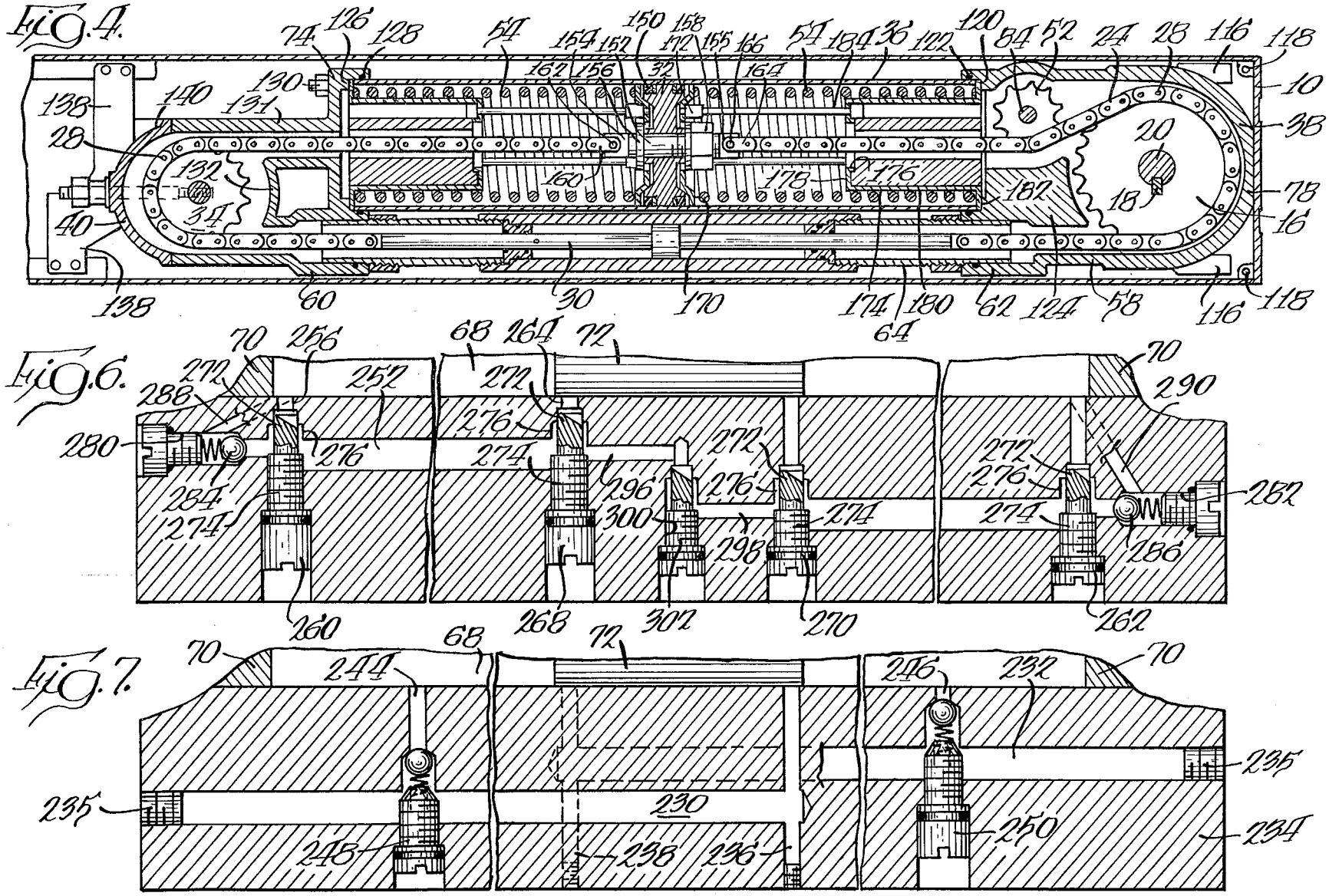

The preferred embodiment will be first described in general terms and the structural details described later. It includes a box 10 adapted to the mounted to the lintel of a doorway overlying the axis of hinging of a single door or, in the case of double doors, extending to overlie the axis of hinging of both doors. Within the box is mounted the pneumatic operator unit 12 and a slave assembly 14 in the event the invention is to be applied to the double door situation. The slave assembly will be omitted in a single door application. The pneumatic operator unit 12 includes a drive sprocket 16 keyed as at 18 to a vertical drive spindle 20 which extends through the bottom of the box 10 and is formed to a square section 22 at its lower end for a driving or a driven connection to the top edge of a swinging door at its axis of hinging.

A horizontal continuous loop 24 including a drive sprocket length of roller chain 26, a take up sprocket length of roller chain 28, a hydraulic rod 30, and a pneumatic piston 32 is entrained over the drive sprocket 16 and a horizontally displaced take-up sprocket 34 to effect driving or driven engagement with the sprocket 16.

The piston 32 is contained in a sleeve 36 or pneumatic cylinder which is closed at the drive sprocket end by a drive sprocket housing 38 and at the other end by a take up sprocket housing 40. The two housings also support their respective sprockets 16 and 34 for rotation. Inlets 42 for air under pressure are provided in each housing. One or the other of these inlets will be used, depending on the desired opening movement of the door, but generally not both unless it is desired that the door open in upon ingress and out upon egress. The inlet ports 42 will be connected through a two way valve 44 to a source of air under pressure 46. The valve 44 is solenoid 48 energized through a normally open mat switch 50 and a normally closed cam operated switch 51 to deliver air into the cylinder when the mat switch is closed and to permit exhaust from the cylinder when the solenoid is de-energized. Safety switches and time delays are involved in the de-energization of the solenoid, but as these are old and well known, they have not been shown.

The sprocket 16 is given as large a diameter as possible within its housing in order to obtain an optimal torque relationship for opening the door and thereby minimize stresses on the hinging parts of the control unit, and the tangent thereto, therefore, is displaced from the central axis of the pneumatic cylinder 36. An idler 52 is mounted in the drive sprocket housing to put the drive sprocket chain 26 on the center line of the cylinder 36 inwardly of the periphery of the drive sprocket.

The piston 32 is centered within the cylinder 36 by caged springs 54 contained between the ends of the cylinder 36 and the piston 32. Pneumatic pressure applied to either end of the cylinder through the inlet ports 42 will drive the piston 32 away from the end of air introduction against the force of the opposite spring 54. The compressed spring 54 will restore the piston 32 to its central position upon relief of pressure.

The housings 38 and 40 not only close off the cylinder 36 but also extend out to the side of the cylinder as at 58 in the case of the drive sprocket housing 38 and 60 in the case of the take up sprocket housing 40. These sideward extensions have facing bores 62 and 63 which connect to pipes 64 and 65 which in turn connect to opposite ends of the hydraulic control unit 66. The hydraulic control unit includes a hydraulic cylinder 68 which is isolated from the pneumatic system by seals 70 embracing the hydraulic rod 30 at each end of the cylinder 68. The hydraulic rod has a hydraulic piston 72 thereon interior of the hydraulic cylinder 68 which is centered within the cylinder when the pneumatic piston 32 is centered as illustrated in FIG. 4 within the pneumatic cylinder 36 under the influence of the caged springs 54. The hydraulic unit, as will be later explained, controls, restrains, and limits the action of applied pneumatic pressure.

Thus, there is a continuous closed path within the apparatus in which the loop 24 is lodged consisting of the pneumatic cylinder 36, the drive sprocket housing 38, the sideward extension 58 of the drive sprocket housing, the pipe 64, the hydraulic cylinder 68, the pipe 65, the sideward extension 60 of the take-up sprocket housing 40, and the take-up sprocket housing 40 itself. It will be appreciated that the take-up sprocket housing end cap 74 and the sideward extension 60 are both in open communication with the cavity which encloses the take-up sprocket 34, and the drive sprocket housing end cap 76 and the sideward extension 58 are both in open communication with the cavity within the housing which contains the drive sprocket 16. The portion of the path within the hydraulic cylinder 68 is isolated by the seals 70 for a separate hydraulic controlling function.

To describe the apparatus in greater detail now, the drive sprocket housing, it will be appreciated, comprises, generally integrally, the pneumatic cylinder cap 76, a flat, sprocket-containing pocket 78 extending from the outer side of the cap 76, and the sideward extension 58 which extends from the pocket to the front side of the cap 76 to open in the same direction as the cap. The pocket has an upper 80 and lower 82 wall. On the back side of the pocket, an idler shaft 84 is contained in appropriate apertures in the upper and lower walls, and the idler 52 is mounted on bearings to the shaft 84 to rotate thereon. As stated, the center line of the pneumatic cylinder 36 is tangent to the periphery of the idler 52. Outwardly of the idler 52, the lower wall 82 of the pocket 78 has a large aperture therein proportioned to admit the drive sprocket 16 for assembly purposes, which is closed by a lower bearing housing 86 bolted as by bolts 88 to the lower wall of the pocket to close the aperture. The lower bearing housing is centrally apertured as at 90 for the through passage of the lower end 22 of the drive sprocket shaft 20 and is configured for the reception of bearings 92 and pneumatic seals 94. The upper wall 80 of the pocket is likewise apertured for the through passage of the drive sprocket shaft 20 and is also suitably configured the reception of bearings 96 and seals 98.

The upper end of the drive sprocket shaft is outwardly shouldered as at 100 within the upper housing wall 80 for positional support of the drive shaft 20 and still further outwardly shouldered as at 102 above the drive sprocket housing. An eccentric cam 104 (See also the diagrammatic pneumatic and electrical diagram at the bottom of FIG. 3) is held against the underside of the shoulder 102 by a snap ring 106. The upper surface of the shoulder 102 is transversely slotted for a stop bar 108 which extends beyond the periphery of the shoulder 102. A post 109 integral with the housing 38 extends upwardly therefrom beside the shoulder 102, and a horizontal screw 111 therein is adjustable to intercept the stop bar 108 and impose a positive mechanical limit to the arc of swing of the door. A slave drive sprocket 110 with a recessed center is secured to the top of the shoulder 102 by bolts 112 and dowels 114. A stud 113 is secured to the top 115 of the box 10 and extends into the recess of the slave drive sprocket for additional support.

The drive sprocket housing is furnished with feet 116 which are screwed to the floor 117 of the box 10. The floor of the box is provided with apertured reinforced corners 118 through which long bolts will secure the assembly to the lintel of a doorway.

The end cap 76 is square in outline, and the receptacle for the pneumatic cylinder is a cylindrical boring 120 in the face of the square with a groove around the inside periphery thereof for a sealing ring 122. An integral web 124 extends between the top wall 80 and the bottom wall 82 of the pocket 78 to provide a continuous edge surface for the pneumatic cylinder receptacle 120 and for the pipe-64-receiving bore 62.

The take-up sprocket housing 40 is similarly configured in these respects. The pneumatic cylinder cap 74 again is square in outline with a cylindrical cavity 126 formed in it and provided with a sealing ring 128 about its inside periphery. The two housings 38 and 40 are secured to the ends of the cylinder 36 and to each other by tie bolts 130 extending between the outwardly standing corners of the end caps outside the cylinder 36.

The take-up sprocket housing likewise includes a relatively flat pocket 131 extending integrally from the back side of the end cap 74 and to the front of the cap to provide for the pipe-65-receiving bore 63. Again, an integral web 132 extends between the top and bottom walls of the pocket generally between the end cap 74 and the frontward extension 60 so as to provide a continuous annular surface for the bore 63 and the cylinder-36 receptacle 126.

The take-up sprocket housing 40 is belled out as at 134 at its remote end and includes a detachable end cap 136. The end cap is a pedestal having feet 138 for attachment to the floor of the box 10, and upwardly of the feet, a domed closure 140 for the otherwise open ended housing 40. A pair of vertically aligned take-up screws 142 extend through the domed closure 140 into the housing 40. The screws 142 are threaded at each end and on their inside ends are threaded into a take-up sprocket shaft 144 upon which the take-up sprocket rotates. Exteriorly of the closure 140, sleeve nuts 146 are threaded on the other threaded ends of the screws 142 for adjustment of the shaft 144 of the take-up sprocket to and from the drive sprocket so as to obtain the desired degree of tautness in the driving loop 24.

The pneumatic piston 32 is a relatively simple disc with seals 150 contained in its periphery and a bolt 152 with outstanding flattened ends 154 and 155 extending through its center. The bolt is held to the piston by a flange 156 inward of the left hand flattened end 154 and a nut 158 engaged on a threaded portion of the bolt inward of the right hand flattened end 155. The end cheek pieces 160 of the take-up sprocket chain 28 are secured by a pin 162 to the flattened end 154 of the bolt 152, and the end cheek pieces 164 of the drive sprocket chain are secured by a pin 166 to the flattened end 155 of the bolt 152.

The caged springs 54 are identical. An annular plate 170 having an exterior diameter to fit within the cylinder 36 and an interior diameter larger than the nut 158 constitutes the inside end of the spring cage or that end against which the piston 32 is moved by pneumatic pressure. One end of the spring 54 bears against the plate 170, and inside the ring of spring bearing, three nuts 172 are secured (only one being illustrated). The other end of the cage is a deep cup 174 with a central hole 176 in its bottom 178 to accommodate through passage and movement of the chain 24. The wall 180 of the cup 174 lies directly inside the spring 54 and at its outer end has an outstanding flange 182. Flange 182 has an exterior diameter equal to exterior diameter of the cylinder 36, and periphery of the flanges 182 are interposed between the cylinder sleeve 36 and the cylinder end caps 74 and 76 to fix the location of the springs within the cylinder 36. Elongated bolts 184 extend through appropriate holes in the inner flange or bottom 178 of the cup 174 and are threaded into the nuts 172 secured to the plate 170. The bolts 184 are adjustable to limit the separate expansion of the springs at a point where the piston 172 is exactly centered, or more precisely, where the controlled door is exactly closed. Movement of the piston away from center immediately encounters substantial spring resistance, but at its centered position the piston has no pressure exerted on it by the springs.

The depth of the cup 180 is determined by the maximum desired extension of the bolts 184 toward the cylinder caps 74 and 76. In other words, upon compression of either spring by displacement by the piston 32 to its maximum desired extent, the bolts 184, whose length is determined by the depth of the cup 180, should stop well short of the cylinder caps.

The hydraulic control unit 66 is a roughly rectangular casting with a vertical orientation separate from the pneumatic system but connected thereto by the pipes 64, 65. Its side-by-side relationship to the pneumatic system can be best observed in FIG. 2. The hydraulic cylinder 68 is a horizontal bore lengthwise through the lower part of the casting. Separate from and above the cylinder 68 is a horizontal reservoir 200. The bore forming the cylinder 68 is enlarged and interiorly threaded at its outer ends 202. The seals 70 are T-shaped annular members, the flanges 204 of which are seated against the shoulders defined by the enlarged ends 202 of the cylinder bore and the pipes 64 and 65 are threaded down on the flanges to clamp the seals 70 in place. The seals are equipped with sealing rings to bear both on the piston rod 30 and the periphery of the cylinder to prevent fluid loss. At their outer ends, the pipes 64 and 65 include telescoping smooth-surfaced tips 206 adapted to engage closely in the bores 62 and 63 and threaded portions 208 inwardly therefrom. Nuts 210 are threaded on the threaded portions to bear firmly against the ends of the extensions 58 and 60 of the drive sprocket housing and the take-up sprocket housing to support the hydraulic assembly 66 firmly in place.

The casting is bored into the ends of the reservoir 200 as at 212, 213 to define a ball check valve seat in each passage 212, 213 and a ball check valve 214 is situated in each passage to permit flow out of the reservoir but not into the reservoir. The passages are outwardly plugged by a plug 216. Vertical bores 218 intersect the bores 212, 213 outwardly of the ball check valve seat and communicate with the hydraulic cylinder 68 immediately inside the seals 70. These passages are plugged as at 220 at their upper ends. The reservoir is also furnished with a filler hole 222 in its top, closed by plug 224.

The hydraulic system as shown in FIGS. 3, 4, 6, and 7 illustrate the position of the hydraulic piston 72 centered within the hydraulic cylinder 68 or midway between the seals 70 which is its position when the door is closed. Since the hydraulic system restrains and controls the effect of applied pneumatic pressure, it must impose the opening and closing characteristics desired upon the door. To this end, a series of passages are formed in the base of the casting 66 below the cylinder 68 to provide for fluid flow from one side of the piston 72 to the other depending upon movement of the door, either pneumatically or manually driven. The arrangements for each side are symmetrical and provide for a controlled opening rate in either direction, a retarded rate or back check as the door approaches its fully open position, a metered closing rate, and a checked closing rate as the door approaches the last few degrees of swing toward its closed position.

To this end, two sets of passage systems are employed. In the set illustrated in FIG. 7, horizontal passages 230 and 232 are drilled in opposite ends of the base 234 of the casting, spatially separated but overlapping to extend to the end of the piston 72 in its centered position remote from the point of entry of the drill, and plugged 235. Vertical plugged passages 236 and 238 intersect the inner ends of passages 230 and 232 and open into the cylinder 68 just inside the ends of the piston 72 in its centered, door closed position. Second passages 244, 246 are drilled upwardly from the bottom of the casting 234 to intersect respectively the passages 230 and 232 and extend into the cylinder 68, each at a point close to but appreciably inward of that end of the cylinder as defined by the seals 70 adjacent the respective ends of entry of the bores 230 and 232. The passages 244, 246 are equipped with combined check and high flow rate metering valves 248 and 250 oriented to permit flow of the cylinder and forbid flow into the cylinder.

FIG. 6 illustrates the other passage system, in somewhat simplified form, however, in that the end portions of the figure are actually at right angles to the plane of the central part of the figure as will be appreciated from the indicative section lines and arrows of FIG. 5.

Plugged passages 252 and 254 (FIG. 5) are extended from the ends of the base to a point just underlying the near edge of the piston 72 in its centered position. Vertical intersecting passages 256 and 258 extend through the passages 252 and 254 and open into the cylinder 68 at its extreme ends defined by the seals 70. The passages 256 and 258 contain metering valves 260 and 262. Other passages 264 and 266 intersect the inner ends of passages 252 and 254 respectively and extend into the cylinder 68 at points just underlying the ends of the piston when the piston is in its centered position. Passages 264 and 266 have metering valves 268 and 270 therein respectively. The stems 272 of valves 260, 262, 268, and 270 are of less diameter than the threaded shanks 274 thereof and the valve seat for each of these valves is defined by the full bore diameter of the threaded shank extending through and beyond the passages 252 and 254 which they intersect. Between that diameter and their entry into the cylinder 68, the passages 256, 258, 262, and 264 are of less diameter. Thus an annular chamber 276 surrounds the stems 272 of these valves into or out of which the metered flow occurs.

Horizontal passages 280 and 282 are bored in the face of the base 234 to intersect the chambers 276 of the metering valves 260 and 262 respectively. These passages are shouldered and furnished with ball check valves 284 and 286 respectively. Vertical passages 288, 290 plugged at their bottom ends extend from a point in the passages 280, 282 upwardly to open into the cylinder 68 immediately adjacent its ends 70. The check valves 284, 286 permit flow from the chambers 276 of metering valves 260, 262 through passages 288, 290 into the cylinder and prevent the flow in the opposite direction.

To provide for two other passages to be described hereafter, the casting 66 is provided with a truncated, vertical, right-triangular, integral extension 292 extending from the front face thereof. From one face of the extension 292, a horizontal plugged passage 296 is drilled to meet the chamber 276 of valve 270, and from the other face, a plugged passage 298 is drilled to meet the chamber 276 of valve 268. It will be noted from FIG. 6 that the passages 296 and 298 are at different vertical elevations. A valve chamber 300 is vertically drilled to intersect both passages 296 and 298, and a metering valve 302 is situated in the valve chamber to restrict adjustably the flow between passages 296 and 298.

The device as thus far described is all that is necessary for the operation of a single door. The assembly will be secured against the lintel of the doorway and a door connected to be driven by or to drive the spindle 20.

Assuming that the device as illustrated in FIG. 4 is to open the door by clockwise rotation of the drive sprocket 16, the pneumatic pressure line will be connected as illustrated in FIG. 3 to the left hand inlet port 42 of the pneumatic cylinder 36. When the mat switch 50 or other actuating means is closed, the solenoid 48 will be energized to operate valve 44 to admit pneumatic pressure to the left hand end of the cylinder. The pneumatic piston 32 will thereupon be urged toward the right hand end of the cylinder 36 against the force of the right hand spring 54, and the entire operating loop 28 will be urged in a clockwise direction so driving the sprocket 16 similarly. The right hand spring 54 will yield and the bolts 182 of the spring cage will be moved upwardly within the cup 174. The left hand spring 54 will be unchanged by the movement since its cage prevents its further expansion. Clockwise movement of the loop will result in a movement of the hydraulic piston 72 to the left as illustrated in FIGS. 6 and 7. It will be appreciated that both ends of the hydraulic cylinder on either side of the piston are full of hydraulic fluid by virtue of gravity flow through the unbiased check valves 214.

As the piston 72 moves to the left, hydraulic fluid ahead of the piston will be forced through passage 244, past the combined check and metering valve 248, and through passage 230 and passage 236 to the back side of the piston. The metering valve 248 will be adjusted to control the rate of such fluid flow. Flow also occurs through the passage 256, past the metering valve 260, through passage 252, around metering valve 268, into passage 296, past metering valve 302, through passage 298, past metering valve 270, and through passage 266 to the back side of the piston. Valves 260 and 302 are set for a relatively low flow rate. Valves 268 and 270 are set for a relatively high flow rate.

In view of the low flow rate imposed by valve 260 in the passage system of FIG. 6, the initial rate of opening will be essentially governed by the passage system of FIG. 7 and hence by the adjustment of valve 248, which will be set for a relatively high flow rate. In other words, the passage system of FIG. 7 governs the opening of the door; the system of FIG. 6 controls the back check and the closing of the door. The reservoir check valves 214 close as the piston moves toward either of them and so forbid bypassing the passage systems through the reservoir.

As the door approaches its fully open position and the piston 72 continues to the left, it covers passage 244 and blocks further flow therethrough. Thereafter, as the piston continues to move, flow occurs exclusively through the second described passage (FIG. 6) wherein escape of fluid is governed by the low flow rate valve 260 to reduce the rate of opening. Flow then continues through the passage 256. At the end of the movement of the piston in the opening direction, the stop bar 108 will encounter the stop screw 111 to impose a positive mechanical limit to the opening of the door so that it cannot be forced open either manually or by pneumatic pressure to any greater degree than the predetermined angle to protect the mechanism of the operator.

Upon release of the pressure or actuation of the valve 44 to vent the pneumatic cylinder, the right hand compressed spring 54 will act on the piston 32 to move it back toward its center position. Under these circumstances, hydraulic fluid must be displaced from the right hand side of the piston 72 to the left hand side thereof. Initial flow occurs through passage 264, past the high flow rate metering valve 274, passage 252, through the chamber 276 surrounding the valve 260, and through the check valve 284 and passage 288 to permit a relatively high flow rate and a normal closing speed of the door. In closing, no flow occurs through passages 230 and 232.

As the piston approaches its center position, it covers passage 264 and flow thereafter continues through passage 266, past valve 270, through passage 298, past the low-flow-rate metering valve 302, through passage 296, around valve 268, through passage 252, around valve 260, past check valve 284, and through passage 288. The introduction of valve 302 into the fluid discharge system results in a sharply reduced rate of closure as the door approaches its closed position for smoothness of closing. Closing movement thus continues until passage 266 is covered and the right hand spring 54 has reached the maximum expansion permitted by its cage. At this point the door will be closed.

The door operates as a panic exit in the same fashion. Let it be assumed that the door opening by clockwise rotation as described above is an inwardly opening door. When moved for panic exit, it will be rotated in a counterclockwise direction. The sprocket 16 will thus be moved in a counterclockwise direction to drive the loop 24 counterclockwise and move the pneumatic piston 32 to the left, so compressing the left hand spring 54 and moving the hydraulic piston 72 to the right. The valve 44 being de-energized, there will be no compression ahead of the pneumatic piston.

As the hydraulic piston moves to the right, controlled relatively free flow of fluid occurs through passage 246, combined check and metering valve 250, passage 232, and passage 238 until the door reaches its near fully open position at which time the piston blocks passage 246. Thereafter restrained flow occurs through passage 258 to the back side of the piston in the same fashion as described above in conjunction with passage 252. When the door reaches its fully open position and passage 258 is covered, the stop bar 108 will be in juxtaposition with the stop screw 111 on the opposite side, again to provide a positive mechanical stop and prevent damage to the operator. Upon the release of the manual hold open, the left hand spring 54 will expand, moving the pneumatic piston 32 to the right and the hydraulic piston to the left and returning the door to closed position. Under this circumstance, flow occurs through passage 266, past metering valve 270, passages 254, check valve 286, and passage 290 until passage 266 is blocked off by the piston. Thereafter, for the last few degrees of closing, flow occurs through passage 264 and the restricted check valve 302 for the retarded closing rate.

One circumstance to be avoided in the use of the door as a panic exit is, as a person exits and steps on the entering mat switch, to have pneumatic pressure applied to the operator to move the door inward when it is manually forced outward. It is to this end that the cam 104 on the drive sprocket shaft is provided. In the schematic electric diagram forming the part of FIG. 3, it will be appreciated that the cam will be so positioned as to open the energizing circuit to the valve 44 when the door is moved away from closure in the direction opposite to intended pneumatic operation.

The slave assembly 14 consists of the slave drive sprocket 110, a driven sprocket 310 having a diameter equal to that of the drive sprocket 110 mounted at the opposite end of the box 10 and a crossed loop 312 including roller chain sections 314 and 316 at its ends.

Referring particularly to FIG. 8, the slave driven sprocket 310 is keyed to the upper end of a shaft 318. A pedestal 320 is secured as by screws 322 to the floor 117 of the box 10. The pedestal has aligned vertical apertures provided with bearing 324 which receive the shaft 318 for rotation. The shaft extends through and beyond the floor 117 of the box and terminates in a squared end 326 in the same fashion as the vertical drive spindle 20 of the drive sprocket 16.

The crossing portion of the loop consists of a pair of rods 328 flattened at one end 330 to be embraced and pinned by the cheek pieces of the end links of the chain 314. The other ends of the rods 328 have threaded adjustment links 340 thereon to adjust the effective length of the loop which are flattened at their free ends 342 and are 343 embraced by the cheek pieces of the ends of the chain 316 and pinned 343. A U-shaped guide 344 is secured to the top of 115 of the housing 10, the arms 346 thereof extending downward to embrace the rods 328 at their point of crossing.

The operation of the slave drive assembly will be evident from the foregoing description. By virtue of the identical diameter of the sprockets 110 and 310, as sprocket 110 moves clockwise through a particular angle, the sprocket 310 will be driven counterclockwise through that same angle. Thus the powered operation of sprocket 110 to open its associated door inwardly will have the effect of driving the door associated with sprocket 310 a like angle also inwardly. Pressure applied to the door associated with the slave sprocket 310, conversely, will have the effect of driving the drive sprocket 110. Thus, with center-opening, paired doors, the two doors are linked together to move, inwardly or outwardly, through equal angles regardless of which door opening pressure is applied to and regardless of whether the application of pressure is through the pneumatic system or manually.

I claim:

1. A hydraulically controlled pneumatic door operator comprising a loop, spaced means supporting said loop at its ends for travel, one of said spaced means being rotatable and adapted for driving connection to a swinging door, said loop being drivingly connected to said one spaced means, a pneumatic piston carried by said loop on one side thereof between said spaced means, a pneumatic cylinder enclosing said pneumatic piston and including resilient means comprising caged springs on each side of said piston to normally position said piston centrally within said cylinder corresponding to door closed position, a hydraulic piston carried by said loop on the other side thereof between said spaced means, a hydraulic cylinder enclosing said hydraulic piston in normally central position, means defining passages for permitting controlled liquid flow from one side of said hydraulic piston to the other in said hydraulic cylinder and means for admitting air under pressure to said pneumatic cylinder to move said piston.

* * * * *